US011536162B2

(12) United States Patent
Yamashita et al.

(10) Patent No.: US 11,536,162 B2
(45) Date of Patent: Dec. 27, 2022

(54) EXHAUST CHAMBER OF STEAM TURBINE, STEAM TURBINE, AND STEAM TURBINE REPLACEMENT METHOD

(71) Applicant: Mitsubishi Power, Ltd., Yokohama (JP)

(72) Inventors: Shoki Yamashita, Yokohama (JP); Takaaki Matsuo, Yokohama (JP); Soichiro Tabata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 79 days.

(21) Appl. No.: 17/261,641

(22) PCT Filed: Sep. 20, 2019

(86) PCT No.: PCT/JP2019/036965
§ 371 (c)(1),
(2) Date: Jan. 20, 2021

(87) PCT Pub. No.: WO2020/066891
PCT Pub. Date: Apr. 2, 2020

(65) Prior Publication Data

US 2021/0262365 A1 Aug. 26, 2021

(30) Foreign Application Priority Data

Sep. 28, 2018 (JP) ..... JP2018-183665

(51) Int. Cl.
*F01D 25/30* (2006.01)
*F01D 25/24* (2006.01)

(52) U.S. Cl.
CPC ..... *F01D 25/30* (2013.01); *F01D 25/24* (2013.01); *F05D 2220/31* (2013.01);
(Continued)

(58) Field of Classification Search
CPC ..... F01D 25/24; F01D 25/30; F05D 2220/31; F05D 2260/31; F05D 2230/80; F05D 2240/12
See application file for complete search history.

(56) References Cited

U.S. PATENT DOCUMENTS 6,261,055 B1 7/2001 Owczarek
6,419,448 B1 7/2002 Owczarek
(Continued)

FOREIGN PATENT DOCUMENTS

JP H8-260904 A 10/1996
JP 2004-353629 A 12/2004
WO 2018/138055 A1 8/2018

OTHER PUBLICATIONS

Notification of Transmittal of Translation of the International Preliminary Report on Patentability (Form PCT/IB/338) issued in counterpart International application No. PCT/JP2019/036965 dated Apr. 8, 2021 with Forms PCT/IB/373 and PCT/ISA/237, with English translation. (17 pages).
(Continued)

*Primary Examiner* — Igor Kershteyn
(74) *Attorney, Agent, or Firm* — WHDA, LLP

(57) ABSTRACT

An exhaust chamber of a steam turbine according to an embodiment includes an outer casing which includes an end wall part in an axial direction and an extension part extending upward in the axial direction from the end wall part, a first flow guide formed into an annular shape, the first flow guide forming an upstream region of a diffuser surface in a hub-side flow guide and being fixed to an upstream end portion of the extension part on a radially inner side of the diffuser surface, and a second flow guide formed into an annular shape, the second flow guide forming a downstream region of the diffuser surface at a position downstream of the
(Continued)

first flow guide and on a radially outer side of the extension part, and being fixed to the extension part.

20 Claims, 7 Drawing Sheets

(52) U.S. Cl.
CPC ..... *F05D 2230/80* (2013.01); *F05D 2240/12* (2013.01); *F05D 2260/31* (2013.01)

(56) References Cited

U.S. PATENT DOCUMENTS

| | | | | |
|---|---|---|---|---|
| 2010/0232966 | A1* | 9/2010 | Ono | F01D 5/225<br>416/179 |
| 2018/0320555 | A1* | 11/2018 | Heo | F01D 25/164 |
| 2020/0011206 | A1* | 1/2020 | Murakami | F01D 25/30 |
| 2020/0173309 | A1* | 6/2020 | Sugishita | F01D 25/24 |

OTHER PUBLICATIONS

International Search Report dated Nov. 19, 2019, issued in counterpart application No. PCT/JP2019/036965, with English translation. (12 pages).

* cited by examiner

EXHAUST CHAMBER OF STEAM TURBINE, STEAM TURBINE, AND STEAM TURBINE REPLACEMENT METHOD

TECHNICAL FIELD

The present disclosure relates to an exhaust chamber of a steam turbine, the steam turbine, and a steam turbine replacement method.

BACKGROUND

Steam from a turbine casing of a steam turbine is normally discharged from the steam turbine via an exhaust chamber. In the exhaust chamber, a fluid loss is caused by characteristics of a steam flow, a shape of an internal structure, or the like. Thus, the shape of a diffuser forming a diffuser flow passage of the exhaust chamber is important.

For example, in a steam turbine described in Patent Document 1, a diffuser length is increased as compared with a conventional one, by extending the end portion of a tip flow guide upper half portion toward downstream, thereby reducing a turbine exhaust loss (see Patent Document 1).

On the other hand, as a recent trend, in terms of a reduction in facility cost, a demand is increased that a diffuser shape is produced individually in accordance with a required specification for each client, whereas an outer casing forming an exhaust chamber is standardized (modularized) to provide an optimized exhaust chamber. Moreover, in order to improve performance, a demand for a replacement work of an existing steam turbine is also increased in which an existing product is diverted as the outer casing, and internal components such as a blade and a diffuser are newly designed.

CITATION LIST

Patent Literature

Patent Document 1: JP2004-353629A

SUMMARY

Technical Problem

In the above-described case, it is desirable that a standardized product or the existing product is diverted as the outer casing of the exhaust chamber, and each of the internal components is designed individually in accordance with an optimum specification, thereby optimizing the diffuser shape.

However, for example, in the steam turbine described in Patent Document 1, a bearing cone constituting the diffuser is formed as a part of an outer casing upper half portion. Thus, in order to optimize the shape of the diffuser, the shape of the bearing cone needs to be changed, and the outer casing upper half portion has to be redesigned. Consequently, for example, in the steam turbine described in Patent Document 1, it is difficult to form a diffuser with an appropriate shape while standardizing the outer casing or diverting the existing product as the outer casing.

In view of the above, an object of at least one embodiment of the present invention is to provide an exhaust chamber of a steam turbine capable of forming the diffuser with the appropriate shape while standardizing the outer casing or diverting the existing product as the outer casing.

Solution to Problem (1) An exhaust chamber of a steam turbine according to at least one embodiment of the present invention includes an outer casing which includes an end wall part in an axial direction and an extension part extending upward in the axial direction from the end wall part, a first flow guide formed into an annular shape, the first flow guide forming an upstream region of a diffuser surface in a hub-side flow guide and being fixed to an upstream end portion of the extension part on a radially inner side of the diffuser surface, and a second flow guide formed into an annular shape, the second flow guide forming a downstream region of the diffuser surface at a position downstream of the first flow guide and on a radially outer side of the extension part, and being fixed to the extension part.

With the above configuration (1), the upstream region of the diffuser surface of the hub-side flow guide is formed by the first flow guide fixed to the upstream end portion of the extension part of the outer casing. Moreover, the downstream region of the hub-side diffuser surface is formed by the second flow guide positioned on the radially outer side of the extension part of the outer casing and fixed to the extension part. Thus, it is possible to form an optimized diffuser shape by changing only the respective shapes of the first flow guide and the second flow guide, without changing the structure of the outer casing. Therefore, it is possible to provide the optimized exhaust chamber by individually forming the diffuser with the appropriate shape for each of the steam turbines while standardizing the outer casing or diverting an existing product as the outer casing.

(2) In some embodiments, in the above configuration (1), the second flow guide includes a diffuser surface forming member for forming the downstream region of the diffuser surface, and a plurality of connection ribs disposed along a circumferential direction, for connecting the diffuser surface forming member and the extension part.

With the above configuration (2), it is possible to arrange the diffuser surface forming member at a position separated from the extension part radially inward by the connection ribs. Moreover, it is also possible to suppress, by the connection ribs, deformation in the diff surface forming member and the extension part, and to improve rigidity of the diffuser surface forming member and the extension part.

(3) In some embodiments, in the above configuration (2), the connection ribs extend in a radial direction.

With the above configuration (3), it is possible to form the appropriate diffuser surface by having a shape of a connected portion to the diffuser surface forming member in the connection ribs along the shape of the diff surface forming member.

(4) In some embodiments, in the above configuration (2) or (3), the second flow guide closes a space formed between the diffuser surface forming member and an inner surface of the outer casing.

With the above configuration (4), it is possible to suppress steam intrusion into the space formed between the diffuser surface forming member and the inner surface of the outer casing, making it possible to reduce a turbine exhaust loss.

(5) In some embodiments, in any one of the above configurations (1) to (4), the second flow guide is formed in an axis direction of a rotor of the steam turbine and has at least two division surfaces extending in a circumferential direction.

With the above configuration (5), the second flow guide is disassembled and assembled easily.

(6) In some embodiments, in any one of the above configurations (1) to (5), the second flow guide is attached to the outer casing to be detachable from the outer casing.

With the above configuration (6), for example, in the existing steam turbine, even if a blade length of the last blade and a position of the last blade along the axial direction of the rotor are changed, causing the need to change the shape of the diffuser for optimization, it is possible to easily detach the existing second flow guide from the extension part, and to easily fix the new second flow guide to the extension part.

(7) In some embodiments, in the above configuration (5) or (6), the outer casing has a division surface extending in the axial direction, for dividing the outer casing into an outer upper half casing and an outer lower half casing in the circumferential direction, and a circumferential position of the division surface matches a position of each of the division surfaces of the second flow guide.

With the above configuration (7), the position of the division surface of the outer casing and the position of each of the division surfaces of the second flow guide are in proximity to each other, facilitating access to the division surfaces of the second flow guide, and facilitating detachment of the second flow guide.

(8) In some embodiments, in any one of the above configurations (1) to (7), the exhaust chamber of the steam turbine further includes a tip-side flow guide forming a tip-side diffuser surface on a radially outer side of the first flow guide.

With the above configuration (8), it is possible to form the diffuser with the appropriate shape by the first flow guide, the second flow guide, and the tip-side flow guide.

(9) In some embodiments, in the above configuration (8), the tip-side flow guide has a downstream end portion positioned upstream of the upstream end portion of the extension part in the axial direction.

With the above configuration (9), it is possible to prevent an interference between the downstream end portion of the tip-side flow guide and the upstream end portion of the extension part, when the outer casing is attached/detached, facilitating attachment/detachment of the outer casing.

(10) In some embodiments, in any one of the above configurations (1) to (9), the first flow guide is detachably supported by the outer casing.

With the above configuration (10), since the first flow guide is detachable from the outer casing, it is possible to prevent interference of the first flow guide with other parts of the steam turbine when the outer casing is attached/detached.

(11) In some embodiments, in any one of the above configurations (1) to (10), a recess is formed, which is positioned on a radially outer side of a downstream end portion of the hub-side flow guide and is recessed downstream of the downstream end portion in the axial direction.

With the above configuration (11), in the exhaust chamber of the steam turbine including the outer casing with the above-described recess, even when a steam flow is biased radially outward and generates a backflow radially inward, for example, in a low-load operation, the backflow is guided by the recess. As a result, it is possible to suppress flowing of the backflow upward where the first flow guide and the second flow guide are positioned. Moreover, it is possible to prevent a circulation region, in which a circulation flow including the backflow circulates, from expanding upstream of the downstream end of the second flow guide. Thus, it is possible to suppress separation of the steam radially inward and to suppress a decrease in effective exhaust area in the exhaust chamber, making it possible to improve a pressure recovery amount of the steam in the exhaust chamber. Therefore, it is possible to reduce a fluid loss in the exhaust chamber, and to improve efficiency of the steam turbine.

(12) A steam turbine according to at least one embodiment of the present invention includes the exhaust chamber of the steam turbine according to any one of the above configurations (1) to (11), a rotor blade disposed upstream of the exhaust chamber of the steam turbine, and a stator vane disposed upstream of the exhaust chamber of the steam turbine.

With the above configuration (12), including the exhaust chamber of the steam turbine according to any one of the above configurations (1) to (11), it is possible to change the respective shapes of the first flow guide and the second flow guide without change the outer shape of the outer casing. Therefore, it is possible to individually form the diffuser with the appropriate shape for each of the steam turbines while standardizing the outer casing, and to reduce the turbine exhaust loss.

(13) A steam turbine replacement method according to at least one embodiment of the present invention includes, in a steam turbine replacement method of replacing a part of an existing steam turbine, a step of detaching an outer upper half casing from the steam turbine, a step of detaching a flow guide forming a diffuser surface from an outer casing, a step of detaching an existing inner casing from an outer lower half casing, a step of preparing a rotor including a last blade and attaching a tip-side flow guide to the inner casing which is newly established, a step of attaching an inner lower half casing to the outer lower half casing and attaching the rotor to the inner lower half casing, a step of attaching a first flow guide and a second lower half flow guide to the outer lower half casing, a step of attaching an inner upper half casing to the outer lower half casing where the inner lower half casing is placed, a step of attaching a second upper half flow guide to the outer upper half casing, and a step of attaching the outer upper half casing to the outer lower half casing.

With the above method (13), in the existing steam turbine, it is possible to increase efficiency of the existing steam turbine by selecting the flow guide with the appropriate shape, while utilizing the existing outer casing.

Note that in any one of the above configurations (1) to (11), the first flow guide may include a diffuser surface forming member for forming the upstream region of the diffuser surface, and a fixing plate part extending radially inward from a downstream end of the diffuser surface forming member and coupled to the upstream end portion of the extension part.

Moreover, in any one of the above configurations (1) to (11), the first flow guide may include a first diffuser surface forming member for forming the upstream region of the diffuser surface, the second flow guide may include a second diffuser surface forming member for forming the downstream region of the diffuser surface, and the first flow guide and the second flow guide may be arranged such that a downstream end of the first diffuser surface forming member and an upstream end of the second diffuser surface forming member face each other in the axial direction.

Furthermore, in any one of the above configurations (1) to (11), the extension part may extend to the upstream end portion fixed to the first flow guide, from a radially inner end of the end wall part toward upstream.

Advantageous Effects

According to at least one embodiment of the present invention, it is possible to individually form a diffuser with an appropriate shape for each of steam turbines while standardizing an outer casing or diverting an existing product as the outer casing.

DETAILED DESCRIPTION

Figure 1:
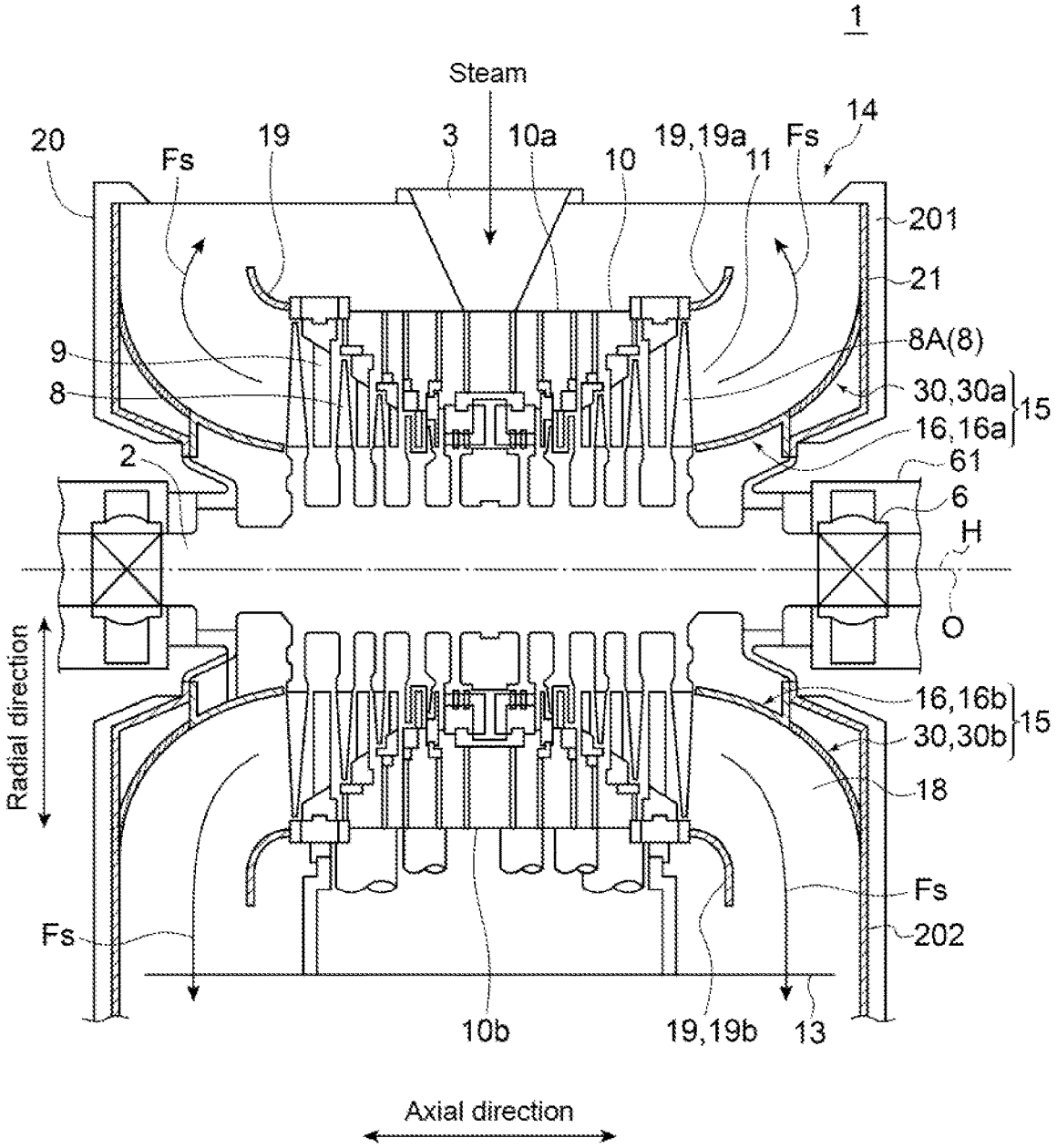
FIG. 1 is a schematic cross-sectional view of a steam turbine according to an embodiment of the present invention, taken along the axial direction.

Some embodiments of the present invention will be described below with reference to the accompanying, drawings. It is intended, however, that unless particularly identified, dimensions, materials, shapes, relative positions and the like of components described in the embodiments or shown in the drawings shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

First, an overall configuration of a steam turbine according to some embodiments will be described.

FIG. 1 is a schematic cross-sectional view of a steam turbine according to an embodiment of the present invention, taken along the axial direction. As shown in FIG. 1, a steam turbine 1 includes a rotor 2 rotatably supported by a bearing 6, a plurality of stages of rotor blades 8 mounted on the rotor 2, an inner casing 10 accommodating the rotor 2 and the rotor blades 8, and a plurality of stages of stator vanes 9 mounted on the inner casing 10 so as to face the rotor blades 8. In addition, an outer casing 20 is disposed outside the inner casing 10. In the above-described steam turbine 1, steam introduced into the inner casing 10 from a steam inlet 3 is expanded and accelerated as the steam passes through the stator vanes 9, and acts on the rotor blades 8 to rotate the rotor 2.

Moreover, the steam turbine 1 includes an exhaust chamber 14. As shown in FIG. 1, the exhaust chamber 14 is positioned downstream of the rotor blades 8 and the stator vanes 9. The steam (steam flows Fs) having passed through the rotor blades 8 and the stator vanes 9 in the inner casing 10 flows into the exhaust chamber 14 from an exhaust chamber inlet 11, passes through the exhaust chamber 14, and is discharged from an exhaust chamber outlet 13 disposed on a lower side of the exhaust chamber 14 to the outside of the steam turbine 1. In some embodiments, a condenser (not shown) is disposed below the exhaust chamber 14. In this case, the steam having acted on the rotor blades 8 in the steam turbine 1 flows from the exhaust chamber 14 into the condenser through the exhaust chamber outlet 13.

Figure 2:
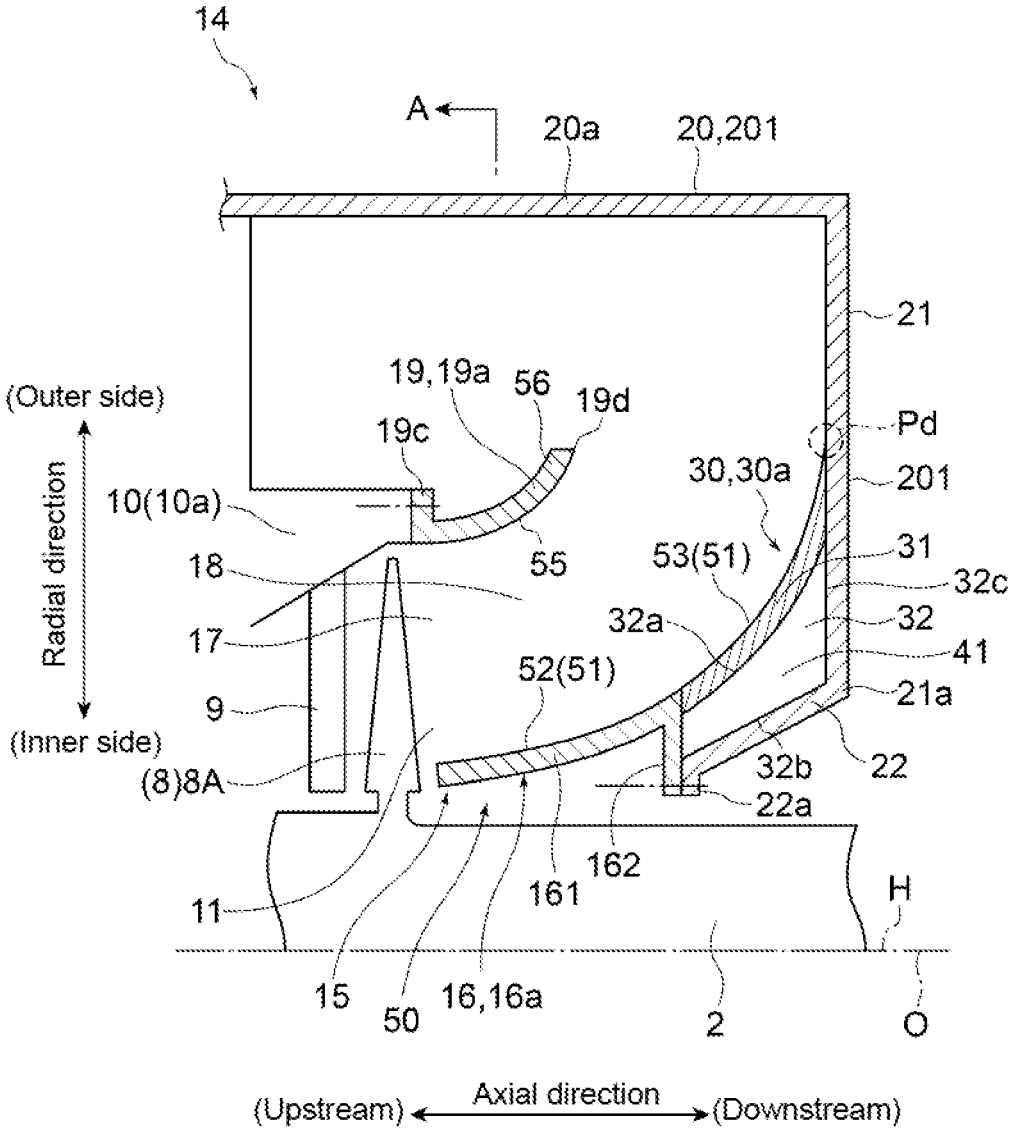
FIG. 2 is a schematic cross-sectional view of an exhaust chamber of a steam turbine according to an embodiment of the present invention, taken along the axial direction.
Figure 3:
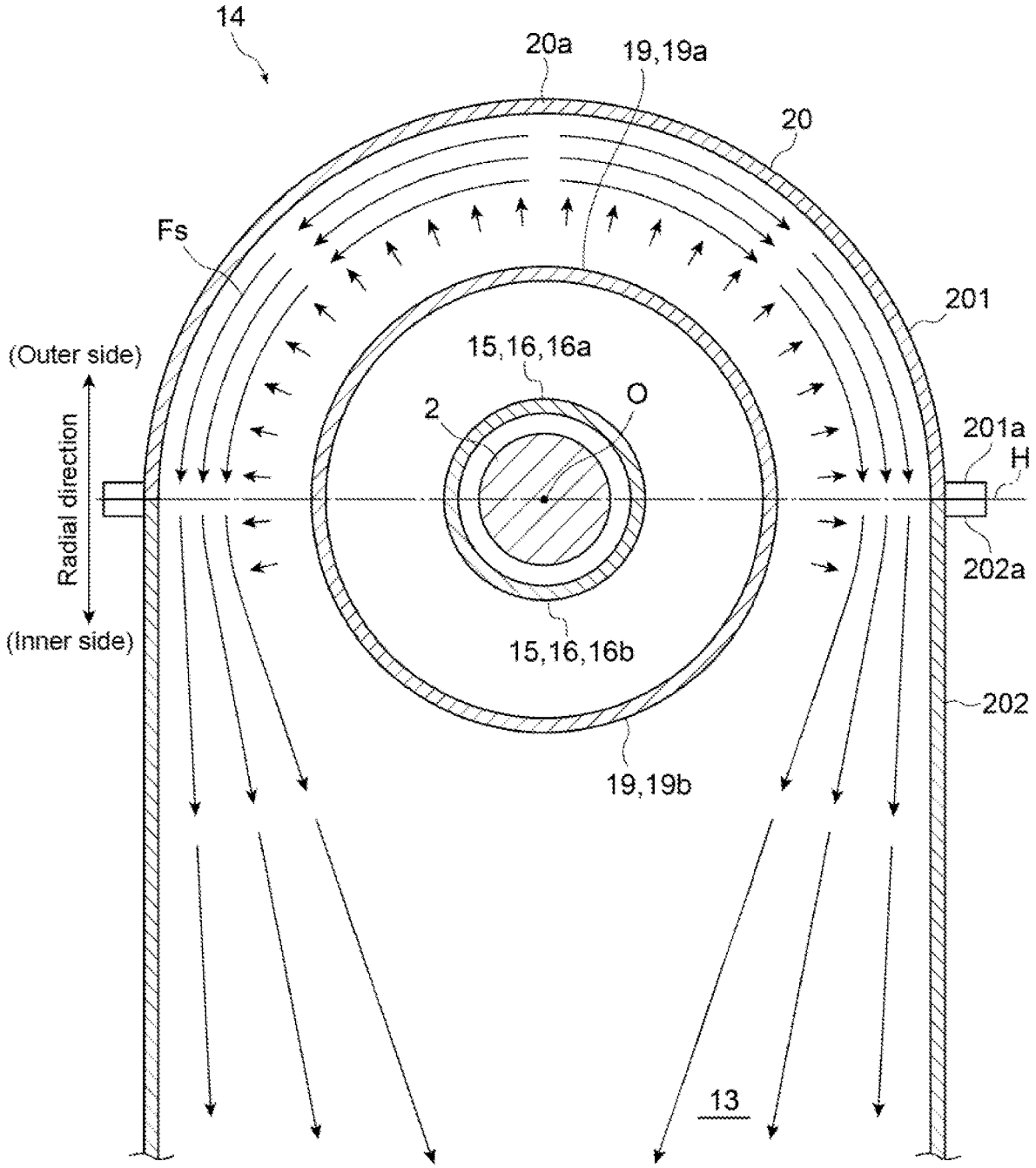
FIG. 3 is a cross-sectional view taken along an arrow A shown in FIG. 2.
Figure 4:
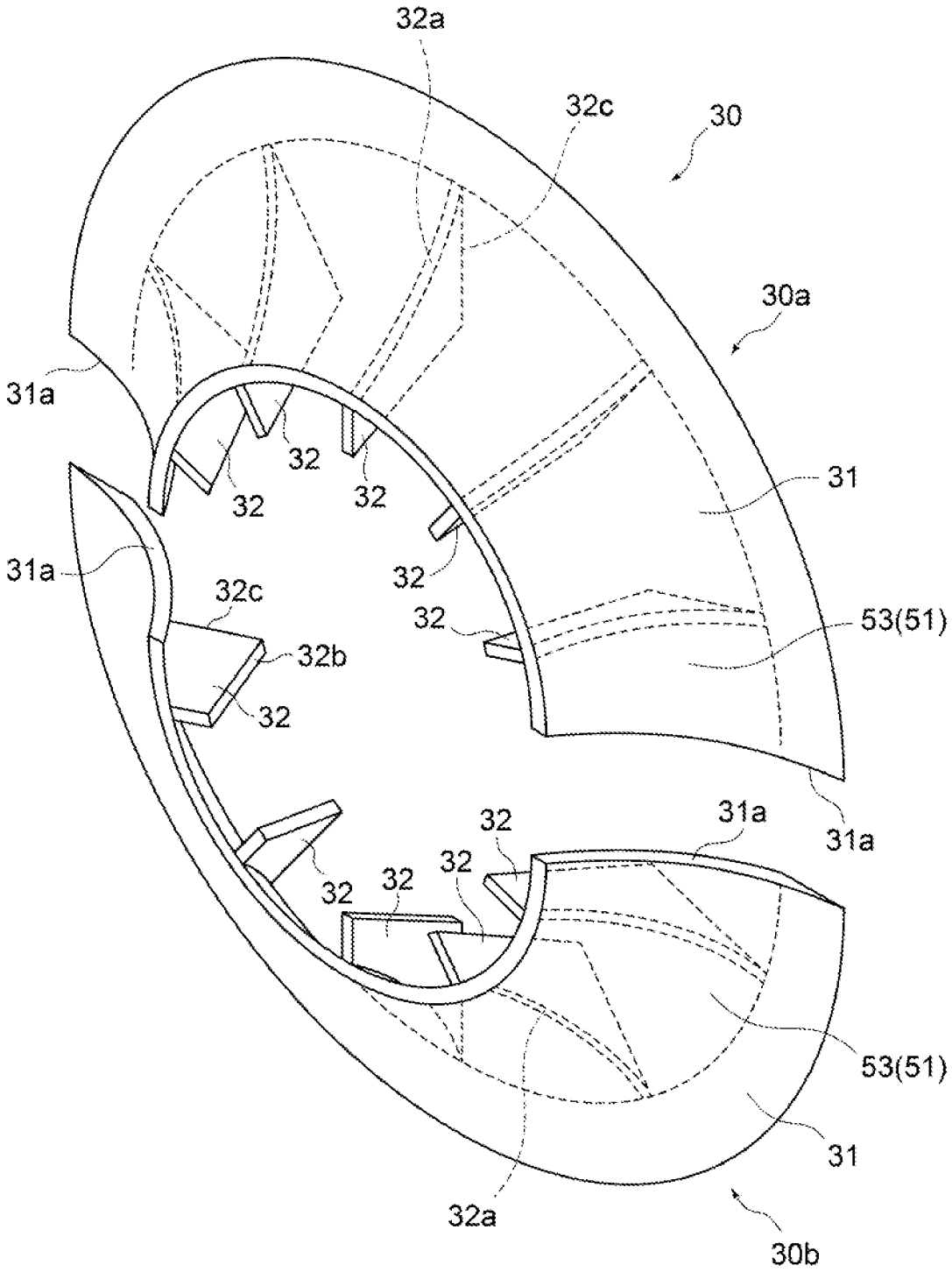
FIG. 4 is a perspective view of a second flow guide shown in FIG. 2.
Figure 5:
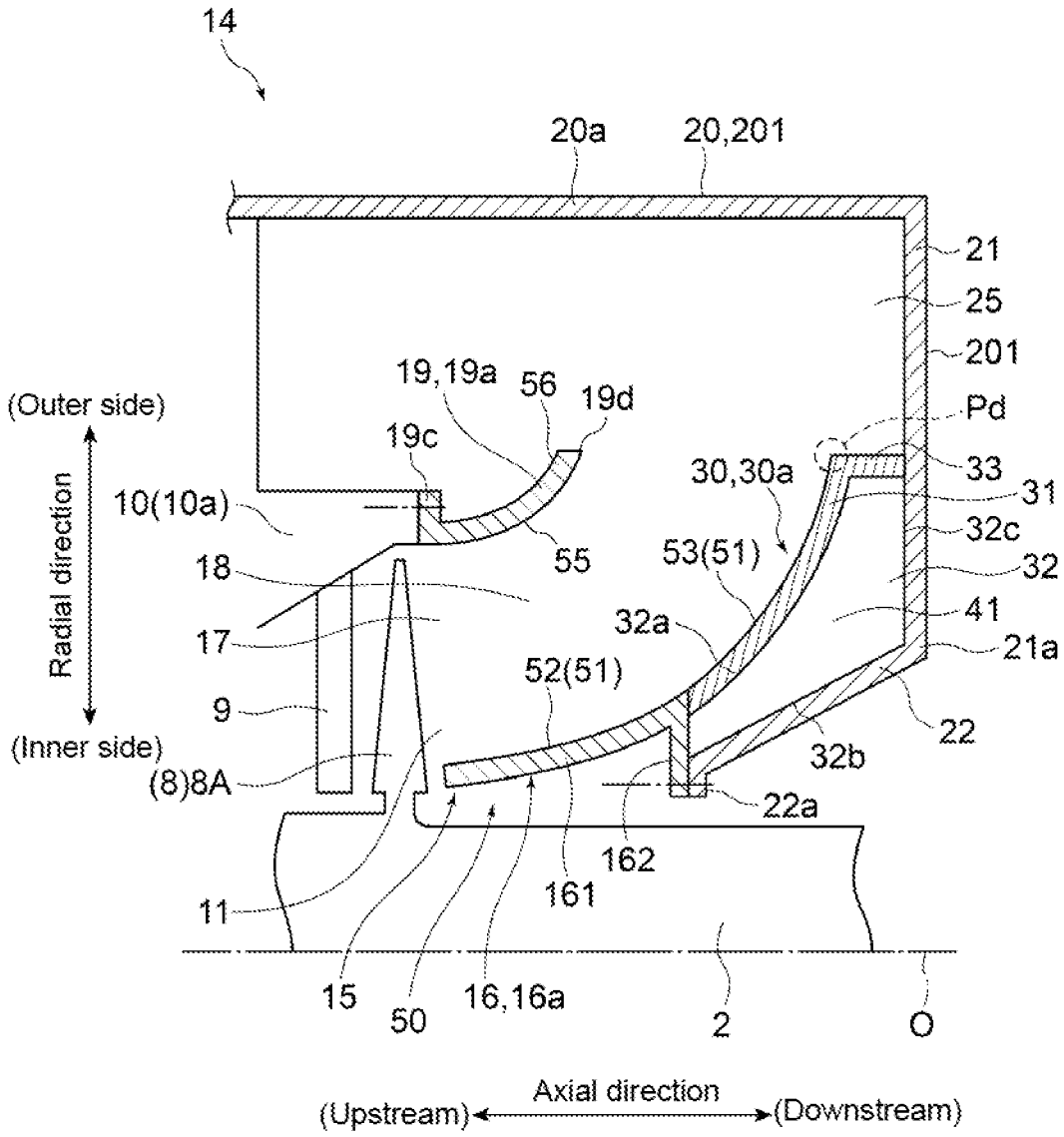
FIG. 5 is a schematic cross-sectional view of the exhaust chamber of the steam turbine according to another embodiment of the present invention, taken along the axial direction.

Next, with reference to FIGS. 1 to 5, a configuration of the exhaust chamber 14 according to some embodiments will be described more specifically FIG. 1 shows an example in which a downflow-type exhaust chamber where the condenser (not shown) is arranged is applied to a lower portion of the steam turbine 1. FIG. 2 is a schematic cross-sectional view of the exhaust chamber of the steam turbine according to an embodiment of the present invention, taken along the axial direction. FIG. 3 is a cross-sectional view taken along an arrow A shown in FIG. 2. FIG. 4 is a perspective view of a second flow guide shown in FIG. 2. FIG. 5 is a schematic cross-sectional view of the exhaust chamber of the steam turbine according to another embodiment of the present invention, taken along the axial direction.

For descriptive convenience, in each of the views, the thickness of a plate-like member is drawn to be larger than the actual thickness thereof.

As shown in FIGS. 1 to 3 and 5, the exhaust chamber 14 according to some embodiments includes the outer casing 20, the inner easing 10 arranged, on the radially inner side of the outer casing 20, a hub-side flow guide 15 attached to the outer casing 20, and a tip-side flow guide 19 attached to the inner casing 10. The hub-side flow guide 15 and the tip-side flow guide 19 are annularly formed, and a diffuser passage 18 surrounded by the hub-side flow guide 15 and the tip-side flow guide 19 forms a diffuser 50. The hub-side flow guide 15 includes a first flow guide 16 forming an axially upstream region 52 of a diffuser surface 51 of the diffuser 50, and a second flow guide 30 forming an axially downstream region 53 of the diffuser surface 51. As shown in FIG. 1, the outer casing 20 of the exhaust chamber 14 may form at least a part of the outer casing of the steam turbine 1. Moreover, in the steam turbine 1 according to some embodiments, the outer casing 20 is disposed separately from a bearing box 61 inside which the bearing 6 is arranged. As shown in FIG. 2 and the like, the central axes of the first flow guide 16, the second flow guide 30, and the tip-side flow guide 19 may be on the same straight line as a center axis O of the rotor 2.

As shown in FIG. 2, the exhaust chamber 14 has the exhaust chamber outlet 13 on the lower side of the exhaust chamber 14. The steam flowing into the exhaust chamber 14 from the exhaust chamber inlet 11 flows inside the exhaust chamber 14 via the diffuser 50 and is discharged from the steam turbine 1 through the exhaust chamber outlet 13. The hub-side flow guide 15 is formed by the axially upstream first flow guide 16 and the second flow guide 30 arranged axially downstream of the first flow guide 16. Each of the hub-side flow guide 15 and the tip-side flow guide 19 is formed annularly around the center axis O of the rotor 2, and has at least two division surfaces in the circumferential direction. Moreover, at least one of the division surfaces may be formed on a horizontal plane including a horizontal line H.

Moreover, as shown in FIG. 3, the exhaust chamber 14 includes the outer casing 20 forming a part of the exhaust chamber. The outer casing 20 has an outer circumferential wall surface 20*a* forming a ceiling surface. The outer circumferential wall surface 20*a* is formed in a radially outer upper region positioned opposite to a radially inner lower region, in which the exhaust chamber outlet 13 is disposed, across the horizontal line H, and is formed into a semi-annular shape in a cross-section orthogonal to the center axis O of the rotor 2. The horizontal line H is a straight line extending along the horizontal direction (right-left direction in FIG. 3) orthogonal to the axis passing through the center axis O of the rotor 2.

In the steam turbine 1 according to some embodiments, the outer casing 20 is configured to be horizontally divisible into an outer upper half casing 201 and an outer lower half casing 202 on the horizontal plane including the horizontal line H. The outer upper half casing 201 and the outer lower half casing 202 include horizontal flanges 201*a*, 202*a* arranged on division surfaces thereof respectively, and are fastened by bolts (not shown), or the like. As with the outer casing 20, as shown in FIG. 1, the inner casing 10 accommodated on the radially inner side of the outer casing 20 is also formed to be divisible into an inner upper half casing 10*a* and an inner lower half casing 10*b* on the horizontal plane including the horizontal line H.

In the steam turbine 1 according to some embodiments, as shown in FIG. 2, the outer casing 20 includes the above-described outer circumferential wall surface 20*a*, an end wall part 21 extending along the radial direction and connected to the outer circumferential wall surface 20*a* at the radially outer end, and an extension part 22 extended so as to form an inclined surface axially upstream and radially inward from a radially inner end 21*a* of the end wall part 21. The extension part 22 serves as a strength member for supporting, for example, a seal structure (not shown) for sealing the first flow guide 16 and the rotor 2, and the radially inner end of the outer casing 20.

The extension part 22 according to some embodiments shown in FIGS. 2 and 5 has, for example, a conical cylindrical shape formed annularly around the center axis O of the rotor 2, and started to decrease, from the radially inner end 21*a* of the end wall part 21, in radial size (a distance from the center axis O of the rotor 2) from downstream toward upstream in the axial direction. That is, in FIG. 2, the extension part 22 is formed so as to decrease in radial size from the right toward the left in the figure. Although not shown, the extension part 22 may have a cylindrical shape in which the radial size is constant regardless of the axial position. An axially downstream end portion of the extension part 22 is connected to an end wall part 21. In an axially upstream end portion of the extension part 22, an upstream end portion 22*a* for attaching the first flow guide 16 is formed, as will be described later.

The first flow guide 16 according to some embodiments shown in FIGS. 2 and 5 is formed annularly around the center axis O of the rotor 2 and increases in radial size from upstream toward downstream in the axial direction. That is, for example, in FIG. 2, the first flow guide is formed so as to increase in radial size from the left toward the right in the figure. Moreover, the first flow guide 16 forms the upstream region 52 of the diffuser surface 51 of the hub-side flow guide 15, as described above. The first flow guide 16 is fixed to the upstream end portion 22*a* of the extension part 22 of the outer casing 20 on the radially inner side of the diffuser surface 51 of the hub-side flow guide 15.

More specifically, the first flow guide 16 according to some embodiments shown in FIGS. 2 and 5 includes a diffuser surface forming member 161 for forming the upstream region 52, and a fixing plate part 162 extending radially inward from an axially downstream end portion of the diffuser surface forming member 161. In the vicinity of a radially inner end portion of the fixing plate part 162, bolt holes (not shown) are formed in a plurality of places along the circumferential direction. The diffuser surface refers to respective inner circumferential surfaces of a diffuser surface forming member 31 and the diffuser surface forming member 161 of the hub-side flow guide 15 forming the diffuser passage 18, and a diffuser surface forming member 56 of the tip-side flow guide 19 that face a steam-passage side.

The first flow guide 16 according to some embodiments shown in FIGS. 2 and 5 is fixed to the upstream end portion 22*a* of the extension part 22 of the outer casing 20 by bolts (not shown) inserted through the above-described bolt holes, respectively. In the upstream end portion 22*a* of the extension part 22, bolt holes (not shown) are formed in a plurality of places along the circumferential direction. That is, the first flow guide 16 according to some embodiments is given cantilever support by the upstream end portion 22*a* of the extension part 22 via the fixing plate part 162.

As described above, the first flow guide 16 is desirably divided into halves in the circumferential direction at least on the horizontal plane including the horizontal line H. The first flow guide 16 is formed by a first upper half flow guide 16*a* attached to the extension part 22 of the outer upper half casing 201, and a first lower half flow guide 16*b* attached to the extension part 22 of the outer lower half casing 202.

The second flow guide 30 according to some embodiments shown in FIGS. 2, 4, and 5 is formed annularly around the center axis O of the rotor 2 and forms the downstream region 53 of the diffuser surface 51 which is a part of the diffuser surface 51 formed so as to increase in radial size from upstream toward downstream in the axial direction. The second flow guide 30 is arranged adjacent axially downstream of the first flow guide 16 and positioned on the radially outer side of the extension part 22 of the outer casing 20. The second flow guide 30 is fixed to the inner side of the outer casing 20 which is the axially upstream region of the end wall part 21 of the outer casing 20 and the radially inner region of the extension part 22 of the outer casing 20.

More specifically, the second flow guide 30 according to some embodiments shown in FIG. 2, 4, 5 includes, of the hub-side flow guide 15, the diffuser surface forming member 31 for forming the downstream region 53 in proximity to the end wall part 21 of the outer casing 20, a plurality of connection ribs 32 disposed along the circumferential direction which is the rotational direction of the rotor 2, for connecting the diffuser surface forming member 31 and the extension part 22, and a tubular wall part 33 formed axially downstream of the diffuser surface forming member 31. The tubular wall part 33 is a tubular member extending downstream along the axial direction from a downstream end portion Pd of the hub-side flow guide 15, formed annularly around the center axis O of the rotor 2, and at least divided into halves in the circumferential direction. The tubular wall part 33 is fixed to the inner wall surface of the end wall part 21 of the outer casing 20 axially downstream.

The second flow guide 30 according to some embodiments shown in FIGS. 2, 4, and 5 is, for example, at least divided into halves along the circumferential direction, and includes a second upper half flow guide 30*a* and a second lower half flow guide 30*b* divided every 180 degrees. For example, if divided into halves, the second upper half flow guide 30*a* and the second lower half flow guide 30*b* are divided by division surfaces 31*a* extending in the same direction as the axis of the rotor 2. The division surfaces 31*a* may be formed such that the second flow guide 30 can be divided into at least thirds in the circumferential direction.

The second upper half flow guide 30*a* of the second flow guide 30 according to some embodiments shown in FIGS. 2, 4, and 5 is attached to the outer upper half casing 201 of the outer casing 20, and the second lower half flow guide 30*b* is attached to the outer lower half casing 202 of the outer casing 20. That is, the division surfaces 31*a* in the second flow guide 30 according to some embodiments may exist in the same plane as the horizontal division surface of the outer casing 20.

The second flow guide 30 according to some embodiments has the same configuration between the second upper half flow guide 30*a* and the second lower half flow guide 30*b*. Thus, the following description will be given by collectively referring the second upper half flow guide 30*a* and the second lower half flow guide 30*b* as the second flow guide 30, unless the second upper half flow guide 30*a* and the second lower half flow guide 30*b* need to be distinguished from each other in particular.

The diffuser surface forming member 31 according to some embodiments is a plate-like member with a curved surface curved such that the radially outer surface forms the downstream region 53 of the hub-side flow guide 15 which is the diffuser surface 51. Note that the downstream region 53 may be formed by dividing the downstream region 53 into a plurality of regions along the circumferential direction and along the axial direction, and substituting curved surfaces forming these regions with flat surfaces, respectively. That is, the diffuser surface forming member 31 may simply be configured by combining a plurality of flat plates for forming the above-described flat surfaces, respectively.

The plurality of connection ribs 32 according to some embodiments are, for example, plate-like members extending along the radial direction and the axial direction, and are arranged radially around the center axis O of the rotor 2 at intervals in the circumferential direction, for example, as shown in FIG. 4.

The connection ribs 32 according to some embodiments is formed into a shape in which a radially outer first end surface 32*a* is along the radially inner circumferential surface of the diffuser surface forming member 31. The first end surface 32*a* is connected to the diffuser surface forming member 31 by, for example, welding.

The connection ribs 32 according to some embodiments is formed into a shape in which a radially inner second end surface 32*b* is along the radially outer inner circumferential surface of the extension part 22. The second end surface 32*b* is connected to the extension part 22 by, for example, welding.

The connection ribs 32 according to some embodiments is formed into a shape in which an axially downstream third end surface 32*c* is along the inner wall surface of the end wall part 21. The third end surface 32*c* is connected to the end wall part 21 by, for example, welding.

The second flow guide 30 according to some embodiments shown in FIGS. 2, 4, and 5 closes a space 41 formed between the diffuser surface forming member 31 and the inner wall surface of the outer casing 20.

Thus, it is possible to suppress steam intrusion into the space 41 formed between the diffuser surface forming member 31 and the inner wall surface of the outer casing 20, making it possible to reduce a turbine exhaust loss.

The tubular wall part 33 in the second flow guide 30 according to an embodiment shown in FIG. 5 has the downstream end portion along the axial direction connected to the inner wall surface of the end wall part 21.

An annular space is formed between the tubular wall part 33 and the outer circumferential wall surface 20*a* on the radially outer side of the tubular wall part 33 in the end wall part 21 of the outer casing 20. The above-described annular space may form a recess 25 which is positioned on the radially outer side of the downstream end portion Pd of the diffuser surface 51 of the hub-side flow guide 15 and is recessed downstream of the downstream end portion Pd in the axial direction.

The tip-side flow guide 19 according to some embodiments shown in FIGS. 2, 3, and 5 is formed by an upper half tip-side flow guide 19*a* attached to the inner upper half casing 10*a*, and a lower half tip-side flow guide 19*b* attached to the inner lower half casing 10*b*. The tip-side flow guide 19 has an upstream end portion 19*c* fixed to the inner casing 10 by, for example a bolt (not shown).

Ta the tip-side flow guide 19 according to some embodiments shown in FIGS. 2 and 5, a downstream end portion 19*d* is positioned axially upstream of the upstream end portion 22*a* of the extension part 22 in the outer casing 20. Thus, for example, when the outer upper half casing 201 of the outer casing 20 is radially attached detached in a replacement work to be described later, it is possible to prevent an interference between the downstream end portion 19*d* of the tip-side flow guide 19 and the upstream end portion 22*a* of the extension part 22 in the outer upper half casing 201, facilitating attachment/detachment of the outer upper half casing 201 of the outer casing 20.

In the exhaust chamber 14 according to some embodiments, as described above, the first flow guide 16, the hub-side flow guide 15 formed by the second flow guide 30, and the tip-side flow guide 19 constitute the diffuser 50 forming the diffuser passage 18 (steam flow passage).

The diffuser passage 18 communicates with a last-stage blade outlet 17 of the steam turbine 1 and has a shape in which the flow passage cross-sectional area formed to be surrounded by the tip-side flow guide 19 and the hub-side flow guide 15 increases gradually. Then, if the high-speed steam flows Fs having passed through a last-stage rotor blade 8A of the steam turbine 1 flow into the diffuser passage 18 via the last-stage blade outlet 17, the steam flows Fs are decreased in speed, and kinetic energy thereof is converted into a pressure (static pressure recovery).

As described above, for example, in a case where a steam turbine is applied in which a casing normalized by standardization (modularization) is applied to the outer casing 20, and the internal components including the diffuser are designed individually in accordance with appropriate shapes and structures, or in a case of a replacement work of an existing steam turbine in which, in order to improve performance, an existing product is diverted as the outer casing, and the internal components are newly designed in accordance with the appropriate shapes satisfying design conditions, even for the steam turbine 1 of the same type, the detailed configuration of the steam turbine 1 may be different due to differences in areas of clients using the steam turbine 1, specifications required by the clients, and the like. Thus, for example, even for the steam turbine 1 of the same type, the blade length of the last-stage rotor blade (last blade) 8A and the position of the last blade 8A along the axial direction of the rotor 2 may be changed. In order to reduce the turbine exhaust loss, it is desirable to optimize the shape of the diffuser 50 in accordance with the changes in blade length of the last blade 8A and position of the last blade SA along the axial direction of the rotor 2.

The existing steam turbine to be a target of the replacement work mentioned herein is the steam turbine 1 with the exhaust chamber 14 which includes the diffuser 50 formed by at least the first flow guide 16 and the second flow guide 30 constituting the hub-side flow guide 15, and the tip-side flow guide 19 shown in some embodiments, and is a steam turbine performing the replacement work for the purpose of a further improvement in performance or the like.

With the exhaust chamber 14 according to some embodiments described above, the upstream region 52 of the diffuser surface 51 of the hub-side flow guide 15 is formed by the first flow guide 16 fixed to the upstream end portion 22*a* of the extension part 22 of the outer casing 20. Moreover, the downstream region 53 of the diffuser surface 51 of the hub-side flow guide 15 is formed by the second flow guide 30 arranged on the radially outer inner circumferential side of the extension part 22 of the outer casing 20 and fixed to the radially outer inner circumferential surface of the extension part 22. Accordingly, arranging the first flow guide 16 forming the optimum diffuser surface 51 of the hub-side flow guide 15 newly designed, and arranging, axially downstream of the first flow guide 16, the second flow guide 30 in accordance with the shape and height of the first flow guide 16 and so as to form the optimum diffuser surface 51, it is possible to form the optimum diffuser passage 18 without changing the outer shape of the outer casing 20. Therefore, it is possible to individually form the diffuser 50 with the appropriate shape for each of the steam turbines 1 while standardizing the outer casing 20 or diverting the existing product as the outer casing 20.

Therefore, according to the steam turbine 1 including the exhaust chamber 14 according to some embodiments described above, it is possible to reduce the turbine exhaust loss.

In the exhaust chamber 14 according to some embodiments described above, since the second flow guide 30 includes the diffuser surface forming member 31 and the connection ribs 32, it is possible to arrange, by the connection ribs 32, the diffuser surface forming member 31 with the appropriate shape at a position separated from the extension part 22 radially outward. Moreover, it is also possible to suppress, by the connection ribs 32, deformation in the diffuser surface forming member 31 and the extension part 22, and to improve rigidity of the diffuser surface forming member 31 and the extension part 22.

In the exhaust chamber 14 according to some embodiments described above, the connection ribs 32 extend in the radial direction.

Thus, having the shape of a connected portion (first end surface 32*a*) to the diffuser surface forming member 31 in the connection ribs 32 along the shape of the diffuser surface forming member 31, the diffuser surface forming member 31 easily maintains the shape of the diffuser surface 51.

In the exhaust chamber 14 according to some embodiments described above, the second flow guide 30 can be divided into at least halves by the division surfaces 31*a* extending in the same direction as the axis of the rotor 2 of the steam turbine 1. Therefore, as described above, forming the division surfaces 31*a* of the second flow guide 30 such that the division surfaces 31*a* of the second flow guide 30 and the division surface of the outer casing 20 exist in the same plane, since the division surface of the outer casing 20 and the division surfaces 31*a* of the second flow guide 30 are in proximity to each other, it is possible to divide the outer casing 20 by disconnecting the division surfaces 31*a* between the second upper half flow guide 30*a* and the second lower half flow guide 30*b*, without detaching each block of the second upper half flow guide 30*a* and the second lower half flow guide from the extension part 22. Moreover, as will be described later, the second flow guide 30 is easily attached and detached. Thus, the exhaust chamber 14 is disassembled and assembled easily.

In the exhaust chamber 14 according to some embodiments described above, the second flow guide 30 is attached to the outer casing 20 to be detachable from the outer casing 20.

That is, in the exhaust chamber 14 according to some embodiments described above, it is possible to detach the second flow guide 30 from the outer casing 20 by, for example, fusing the connection ribs 32 at positions close to connected portions to the extension part 22 and the end wall part 21, respectively. Some of the connection ribs 32 remaining in the extension part 22 and the end wall part 21 can be removed from the extension part 22 and the end wall part 21 by rising, for example, a grinder. As a means for fixing the second flow guide 30 to the extension part 22, the second flow guide 30 may be fixed by welding or the like, or may have a detachable structure by a bolt or the like.

Thus, for example, in the replacement work of the existing steam turbine 1, even if the blade length of the last blade 8A and the position of the last blade 8A along the axial direction of the rotor 2 are changed, causing the need to change the shape of the diffuser 50 for optimization, it is possible to easily detach the existing second flow guide 30 from the extension part 22, and to easily fix the new second flow guide 30 to the extension part 22.

In some embodiments described above, the outer casing 20 has a division surface extending in the axial direction, for dividing the outer casing 20 into the outer upper half casing 201 and the outer lower half casing 202 in the circumferential direction, and a circumferential position of the division surface matches a circumferential position of each of the division surfaces 31*a* of the second flow guide 30.

Thus, the position of the division surface of the outer casing 20 and the position of each of the division surfaces 31*a* of the second flow guide 30 are in proximity to each other, facilitating access to the division surfaces 31*a* of the second flow guide 30, and facilitating attachment and detachment of the second flow guide 30.

In the exhaust chamber 14 according to some embodiments described above, the first flow guide 16 is detachably supported by the outer casing 20.

For example, when the outer casing 20 is lifted from the steam turbine 1 by using a crane or the like to be attached/detached while the outer casing 20 supports the first flow guide 16, the first flow guide 16 may interfere with other parts of the steam turbine 1. In this regard, with the exhaust chamber 14 according to same embodiments described above, since the first flow guide 16 is detachable from the outer casing 20, it is possible to prevent interference of the first flow guide 16 with the other parts of the steam turbine 1 when die outer casing 20 is attached to/detached from the steam turbine 1.

(Recess 25)

Figure 6:
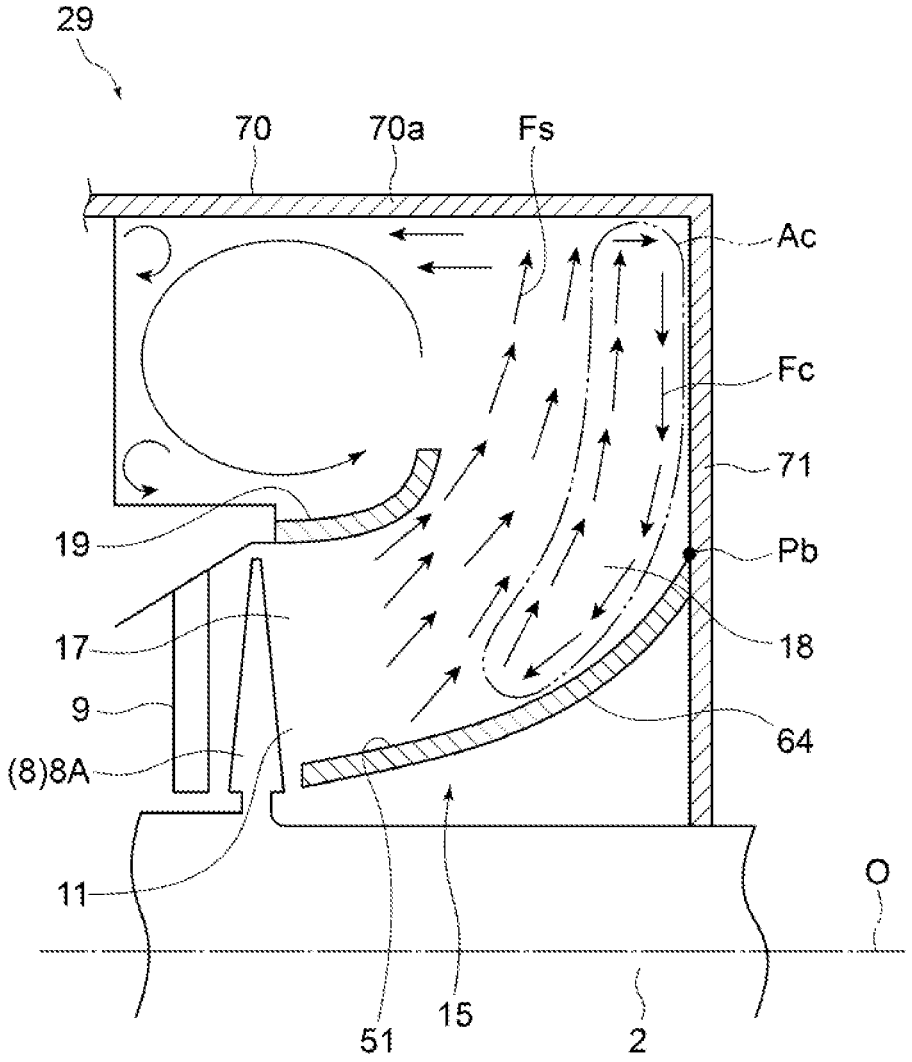
FIG. 6 is a schematic cross-sectional view of an exhaust chamber of a steam turbine according to a comparative example, taken along the axial direction.

FIG. 6 is a schematic cross-sectional view of an exhaust chamber of a steam turbine according to a comparative example, taken along the axial direction. In FIG. 6, members indicated by the same reference characters as in some embodiments shown in FIGS. 1 to 5 are not described again in detail.

An exhaust chamber 29 of the comparative example shown in FIG. 6 includes an outer casing 70, a bearing cone 64 corresponding to the huh-side flow guide, and the tip-side flow guide 19. The outer casing 70 is formed by an outer circumferential wall surface 70*a* forming a ceiling surface and an end wall part 71 extending along the radial direction. Moreover, the bearing cone 64 forms the diffuser surface 51 of the hub-side flow guide 15, and the downstream end portion of the bearing cone 64 is smoothly joined to the end wall part 71 of the outer casing 70 at an intermediate position of the end wall part 71. The outer casing 70 is configured such that the above-described recess 25 is not arranged downstream of the bearing cone 64.

The present inventors have found that when the steam flows Fs drift toward the tip-side flow guide 19, the exhaust chamber 29 of the comparative example including the above-described outer casing 70 causes separation at the bearing cone 64, which increases a fluid loss in the exhaust chamber 29. Here, the steam turbine 1 is designed so that the steam flows along the axial direction from the last-stage blade outlet 17 in a normal operation. On the other hand, in a low-load operation, the outflow speed of the steam decreases compared to the normal operation, although the rotational speed of the rotor blade 8 is not different from the normal operation. Thus, the steam flowing from the last-stage blade outlet 17 in the low-load operation has a large proportion of a swirl component to an axial component, and thus the flow is biased to the tip-side flow guide 19.

One of causes of the separation of the steam flows Fs at the bearing cone 64 is that some of the steam flows Fs biased to the tip-side flow guide 19 impinge on the outer circumferential wall surface 70*a* and flows back upstream along the end wall part 71 and the bearing cone 64 positioned upstream of the end wall part 71 to be backflows Fc flowing in a direction opposite to the normal steam flows Fs, as shown in FIG. 6. The backflows Fe in the exhaust chamber 29 are pushed back downstream by the steam flows Fs in the vicinity of an axially intermediate position of bearing cone 64. Therefore, as shown in FIG. 6, some of the steam flows Fs may form a circulation region Ac where the backflows Fe circulating in the vicinity of the bearing cone 64 are generated. Since the circulation region Ac formed in the exhaust chamber 29 expands to a region upstream of a downstream end Pb of the bearing cone 64, separation of the steam flows Fs occurs at the bearing cone 64, as well as an effective exhaust area in the exhaust chamber 29 decreases, and a fluid loss in the exhaust chamber 29 increases.

Thus, the present inventors have arrived at forming the above-described recess 25 downstream of the bearing cone 64 to guide the steam flows Fs to prevent inflow of the backflows Fe to the bearing cone 64, thereby suppressing separation of the steam flows Fs at the bearing cone 64.

In some embodiments, the exhaust chamber 14 includes the recess 25 which is recessed on the radially outer side of the position of the downstream end portion Pd of the diffuser surface 51 of the hub-side flow guide 15 and axially downstream of the downstream end portion Pd.

With the above configuration, in the exhaust chamber 14 of the steam turbine 1 including the outer casing 20 with the above-described recess 25, even when the steam flow is biased radially outward and generates the backflows Fe radially inward, for example, in the low-load operation, the recess 25 guides the backflows Fe into the recess 25. Therefore, even if the circulation region Ac including the backflows Fc is generated, it is possible to prevent the circulation region Ac from expanding upstream of the downstream end portion. Pd of the second flow guide 30. Providing the recess 25, it is possible to suppress separation of the steam flows Fs on the radially inner side of the diffuser passage 18 and to suppress a decrease in effective exhaust area in the exhaust chamber 14, making it possible to improve a pressure recovery amount of the steam in the exhaust chamber 14. Therefore, it is possible to reduce the fluid loss in the exhaust chamber 14, and to improve efficiency of the steam turbine 1.

(Steam Turbine Replacement Method)

In the exhaust chamber 14 according to some embodiments, as described above, the second flow guide 30 is attached to the outer casing 20 to be detachable from the outer casing 20.

Therefore, in the replacement work of the existing steam turbine 1, replacement with the diffuser 50 having the appropriate shape is possible while utilizing the existing outer casing 20, even if the shape of the diffuser 50 is changed by changing the blade length of the last blade 8A and the position of the last blade 8A along the axial direction of the rotor 2. A steam turbine replacement method according to an embodiment will be described below.

Figure 7:
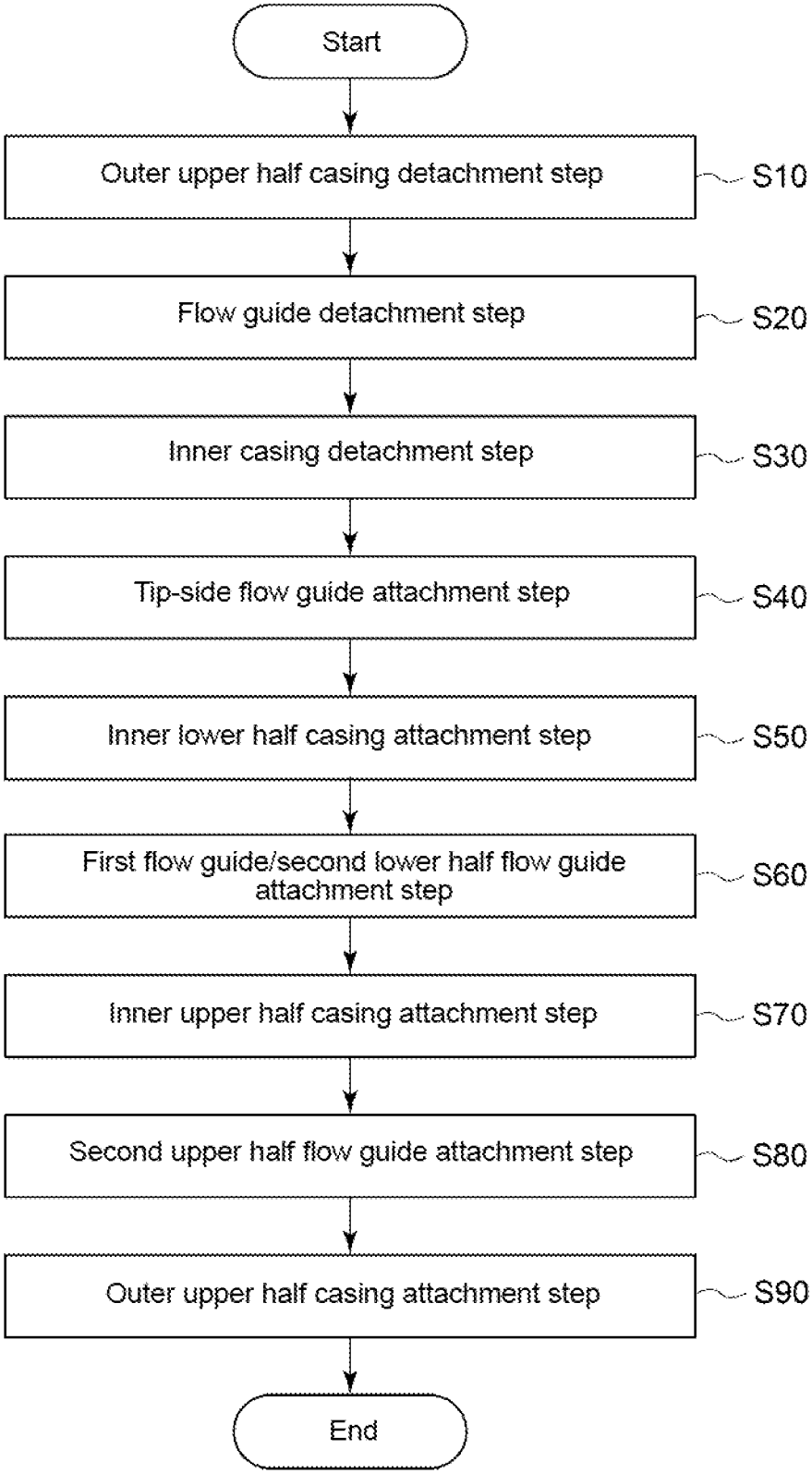
FIG. 7 is a flowchart showing a processing procedure in a steam turbine replacement method according to an embodiment.

FIG. 7 is a flowchart showing a processing procedure in the steam turbine replacement method according to an embodiment. The steam turbine replacement method according to an embodiment includes, in a replacement method of the steam turbine 1 of replacing a part of the existing steam turbine 1, an outer upper half casing detachment step S10, a flow guide detachment step S20, an inner casing detachment step S30, a tip-side flow guide attachment step S40, an inner lower half casing attachment step S50, a first flow guide and second lower half flow guide attachment step S60, an inner upper half casing attachment step S70, a second upper half flow guide attachment step S80, and an outer upper half casing attachment step S90.

The outer upper half casing detachment step S10 is a step of detaching the outer upper half casing 201 from the existing stearin turbine 1. More specifically, the outer upper half casing detachment step S10 includes a step of separating the outer upper half casing 201 of the existing outer casing 20 from the outer lower half casing 202 after coupling between the existing first flow guide 16 and the upstream end portion 22*a* of the extension part 22 is released. The outer lower half casing 202 is retained in an existing place until the internal components such as the rotor including a newly-established blade and the inner casing can be accepted.

The flow guide detachment step S20 is a step of detaching the existing flow guides (hub-side flow guide 15 (first flow guide 16, second flow guide 30), tip-side flow guide 19) each forming the diffuser. More specifically, the flow guide detachment step S20 includes detaching the existing tip-side flow guide 19 from the inner casing 10. Moreover, the existing hub-side flow guide 15 detaches the fixing plate part 162 of the first flow guide 16 from the upstream end portion 22*a* of the extension part 22 in the outer casing 20 (outer upper half casing 201, outer lower half casing 202) by which the first flow guide 16 is supported, thereby detaching the existing first flow guide 16 (first upper half flow guide 16*a*, first lower half flow guide 16*b*) from the steam turbine 1. Furthermore, the existing second flow guide 30 (second upper half flow guide 30*a*, second lower half flow guide 30*b*), for example, as described above, fuses the connection ribs 32 to separate the second flow guide 30 with the connection ribs 32 from the end wall part 21 or the extension part 22, thereby detaching the existing second flow guide 30 from the outer casing 20 (outer upper half casing 201, outer lower half casing 202).

The inner casing detachment step S30 is a step of detaching the inner casing 10 (inner upper half casing 10*a*, inner lower half casing 10*h*) which accommodates, for example, the rotor 2 provided with the existing blades from the existing outer lower half casing 202.

The tip-side flow guide attachment step S40 is a step of attaching the newly-established tip-side flow guide 19 to the newly-established inner casing 10 which is produced additionally. That is, the tip-side flow guide attachment step S40 includes attaching, to the newly-established rotor 2 produced additionally, a newly-established last blade and the like in which the blade length and position of the last blade 8A or the like is changed or adjusted in accordance with the appropriate shape and blade length in line with the design conditions, and preparing the newly-established rotor 2 provided with the last blade.

The inner lower half casing attachment step S50 is a step of attaching only the inner lower half casing 10*b* of the inner easing 10 to the existing outer lower half casing 202. Moreover, the inner lower half casing attachment step S50 includes attaching the newly-established rotor 2 produced in the tip-side flow guide attachment step S40.

The first flow guide and second lower half flow guide attachment step S60 includes attaching the first lower half flow guide 16*b* to the extension part 22 of the existing outer lower half casing 202 by a fastening means such as a bolt. Moreover, the first upper half flow guide 16*a* is temporarily, attached to the extension part 22 of the existing outer lower half casing 202 by the same means at the position of the horizontal division surface of the existing outer lower half casing 202. Moreover, the first flow guide and second lower half flow guide attachment step S60 includes attaching the second lower half flow guide 30*b* of the second flow guide 30 to the outer lower half casing 202 by welding or the fastening means such as the bolt.

The inner upper half casing attachment step S70 is a step of attaching the newly-established inner upper half casing 10*a* to the upper portion of the inner lower half casing 10*b* placed on the existing outer lower half casing 202 to be attached. The inner upper half casing 10*a* is attached while including the upper half tip-side flow guide 19*a* attached in the tip-side flow guide attachment step S40.

The second upper half flow guide attachment step S80 is a step of attaching, by welding or the fastening means such as the bolt, the second upper half flow guide 30*a* to the existing separate outer upper half casing 201 detached from the existing outer lower half casing 202 in the outer upper half casing detachment step S10.

The outer upper half casing attachment step S90 includes attaching, to the existing outer lower half casing 2202, the outer upper half casing 201 attached to the second upper half flow guide 30*a* in the second upper half flow guide attachment step S80. Furthermore, the first upper half flow guide 16*a*, which is temporarily attached to the extension part 22 of the existing outer lower half casing 202 in the first flow guide and second lower half flow guide attachment step S60, is attached to the extension part 22 of the outer upper half casing 201 by welding or the fastening means such as the bolt, terminating the replacement work.

Thus, with the steam turbine replacement method according to an embodiment, replacement with the diffuser 50 having the appropriate shape is possible while utilizing the existing outer casing 20, even if the shape of the diffuser 50 is changed by changing the blade length of the last blade 8A and the position of the last blade 8A along the axial direction of the rotor 2, in the existing steam turbine 1. Thus, the facility cost of the existing steam turbine 1 is reduced, and it is possible to achieve an improvement in performance of the steam turbine 1.

The present invention is not limited to the above-described embodiments, and also includes an embodiment obtained by modifying the above-described embodiments and an embodiment obtained by combining these embodiments as appropriate.

For example, the exhaust chamber 14 according to some embodiments described above is the exhaust chamber of a downflow exhaust type for exhausting steam downward. However, the present invention is applicable to au exhaust chamber of a side exhaust type for exhausting steam laterally.

In some embodiments described above, the second flow guide 30 connects the connection ribs 32 to the extension part 22 and the end wall part 21 by welding. However, for example, a seat for coupling the connection ribs 32 by bolts and nuts may be provided for the extension part 22 and the end wall part 21 in advance, and the connection ribs 32 may be coupled to the seat by the bolts and the nuts, respectively.

REFERENCE SIGNS LIST

1 Steam turbine
2 Rotor
6 Bearing
8 Rotor blade
9 Stator vane
10 Inner casing
10*a* Inner upper half casing
10*b* Inner lower half casing
14 Exhaust chamber
15 Hub-side flow guide
16 First flow guide
16*a* First upper half flow guide
16*b* First lower half flow guide
18 Diffuser passage
19 Tip-side flow guide
19*a* Upper half tip-side flow guide
19*b* Lower half tip-side flow guide
20 Outer casing
21 End wall part
22 Extension part
22*a* Upstream end portion
25 Recess
30 Second flow guide
30*a* Second upper half flow guide
30*b* Second lower half flow guide
31 Diffuser surface forming member
32 Connection rib
41 Space
50 Diffuser
51 Hub-side diffuser surface
52 Upstream region
53 Downstream region
55 Tip-side diffuser surface
56 Diffuser surface forming member
201 Outer upper half casing
202 Outer lower half casing

The invention claimed is:

1. An exhaust chamber of a steam turbine, comprising:

an outer casing which includes an end wall part in an axial direction and an extension part extending upward in the axial direction from the end wall part;

a first flow guide formed into an annular shape, the first flow guide forming an upstream region of a diffuser surface of a hub-side flow guide and being fixed to an upstream end portion of the extension part on a radially inner side of the diffuser surface; and a second flow guide formed into an annular shape, the second flow guide forming a downstream region of the diffuser surface at a position downstream of the first flow guide and on a radially outer side of the extension part, and being fixed to the extension part, wherein the second flow guide is formed in an axis direction of a rotor of the steam turbine and has at least two division surfaces extending in a circumferential direction.

2. The exhaust chamber of the steam turbine according to claim 1, wherein the second flow guide includes a diffuser surface forming member for forming the downstream region of the diffuser surface, and a plurality of connection ribs disposed along a circumferential direction, for connecting the diffuser surface forming member and the extension part.

3. The exhaust chamber of the steam turbine according to claim 2, wherein the connection ribs extend in a radial direction.

4. The exhaust chamber of the steam turbine according to claim 2, wherein the second flow guide closes a space formed between the diffuser surface forming member and an inner surface of the outer casing.

5. The exhaust chamber of the steam turbine according to claim 3, wherein the second flow guide closes a space formed between the diffuser surface forming member and an inner surface of the outer casing.

6. The exhaust chamber of the steam turbine according to claim 1, wherein the second flow guide is attached to the outer casing to be detachable from the outer casing.

7. The exhaust chamber of the steam turbine according to claim 1, wherein the outer casing has a division surface extending in the axial direction, for dividing the outer casing into an outer upper half casing and an outer lower half casing in the circumferential direction, and a circumferential position of the division surface matches a position of each of the division surfaces of the second flow guide.

8. The exhaust chamber of the steam turbine according to claim 6, wherein the outer casing has a division surface extending in the axial direction, for dividing the outer casing into an outer upper half casing and an outer lower half casing in the circumferential direction, and a circumferential position of the division surface matches a position of each of the division surfaces of the second flow guide.

9. The exhaust chamber of the steam turbine according to claim 1, further comprising:

a tip-side flow guide forming a tip-side diffuser surface on a radially outer side of the first flow guide.

10. The exhaust chamber of the steam turbine according to claim 9, wherein the tip-side flow guide has a downstream end portion positioned upstream of the upstream end portion of the extension part in the axial direction.

11. The exhaust chamber of the steam turbine according to claim 1, wherein the first flow guide is detachably supported by the outer casing.

12. The exhaust chamber of the steam turbine according to claim 1, wherein a recess is formed, which is positioned on a radially outer side of a downstream end portion of the hub-side flow guide and is recessed downstream of the downstream end portion in the axial direction.

13. The exhaust chamber of the steam turbine according to claim 1, wherein the first flow guide includes:

a diffuser surface forming member for forming the upstream region of the diffuser surface; and a fixing plate part extending radially inward from a downstream end of the diffuser surface forming member and coupled to the upstream end portion of the extension part.

14. The exhaust chamber of the steam turbine according to claim 1, wherein the first flow guide includes a first diffuser surface forming member for forming the upstream region of the diffuser surface, wherein the second flow guide includes a second diffuser surface forming member for forming the downstream region of the diffuser surface, and wherein the first flow guide and the second flow guide are arranged such that a downstream end of the first diffuser surface forming member and an upstream end of the second diffuser surface forming member face each other in the axial direction.

15. The exhaust chamber of the steam turbine according to claim 1, wherein the extension part extends to the upstream end portion fixed to the first flow guide, from a radially inner end of the end wall part toward upstream.

16. A steam turbine, comprising:

the exhaust chamber of the steam turbine according to claim 14;

a rotor blade disposed upstream of the exhaust chamber of the steam turbine; and a stator vane disposed upstream of the exhaust chamber of the steam turbine.

17. A steam turbine replacement method of replacing a part of an existing steam turbine, comprising:

a step of detaching an outer upper half casing from the steam turbine;

a step of detaching a flow guide forming a diffuser surface from an outer casing;

a step of detaching an existing inner casing from an outer lower half casing;

a step of preparing a rotor including a last blade and attaching a tip-side flow guide to the inner casing which is newly established;

a step of attaching an inner lower half casing to the outer lower half casing and attaching the rotor to the inner lower half casing;

a step of attaching a first flow guide and a second lower half flow guide to the outer lower half casing;

a step of attaching an inner upper half casing to the outer lower half casing where the inner lower half casing is placed;

a step of attaching a second upper half flow guide to the outer upper half casing; and a step of attaching the outer upper half casing to the outer lower half casing.

18. An exhaust chamber of the steam turbine, comprising:

an outer casing which includes an end wall part in an axial direction and an extension part extending upward in the axial direction from the end wall part;

a first flow guide formed into an annular shape, the first flow guide forming an upstream region of a diffuser surface of a hub-side flow guide and being fixed to an upstream end portion of the extension part on a radially inner side of the diffuser surface; and a second flow guide formed into an annular shape, the second flow guide forming a downstream region of the diffuser surface at a position downstream of the first flow guide and on a radially outer side of the extension part, and being fixed to the extension part, wherein a recess is formed, which is positioned on a radially outer side of a downstream end portion of the hub-side flow guide and is recessed downstream of the downstream end portion in the axial direction.

19. The exhaust chamber of the steam turbine according to claim 18, wherein the second flow guide includes a diffuser surface forming member for forming the downstream region of the diffuser surface, and a plurality of connection ribs disposed along a circumferential direction, for connecting the diffuser surface forming member and the extension part.

20. The exhaust chamber of the steam turbine according to claim 18, wherein the first flow guide includes a first diffuser surface forming member for forming the upstream region of the diffuser surface, wherein the second flow guide includes a second diffuser surface forming member for forming the downstream region of the diffuser surface, and wherein the first flow guide and the second flow guide are arranged such that a downstream end of the first diffuser surface forming member and an upstream end of the second diffuser surface forming member face each other in the axial direction.

* * * * *